US011746999B1

(12) United States Patent
Ernst et al.

(10) Patent No.: US 11,746,999 B1
(45) Date of Patent: Sep. 5, 2023

(54) HEADLAMP WITH BATTERY UNIT AND BOOSTER UNIT

(71) Applicant: Coast Cutlery Co., Portland, OR (US)

(72) Inventors: Todd Ernst, Portland, OR (US); Brian Sheehy, Los Angeles, CA (US); David Goldman, Portland, OR (US); David D. Lewin, Portland, OR (US)

(73) Assignee: Coast Cutlery Co., Portland, OR (US)

( * ) Notice: Subject to any disclaimer, the term of this patent is extended or adjusted under 35 U.S.C. 154(b) by 0 days.

(21) Appl. No.: 17/740,340

(22) Filed: May 9, 2022

(51) Int. Cl.

| | |
|---|---|
| ***F21V 21/084*** | (2006.01) |
| ***F21V 23/06*** | (2006.01) |
| ***F21V 17/10*** | (2006.01) |
| ***F21S 9/02*** | (2006.01) |

(52) U.S. Cl.
CPC ..... *F21V 21/084* (2013.01); *F21S 9/02* (2013.01); *F21V 17/105* (2013.01); *F21V 23/06* (2013.01)

(58) Field of Classification Search
CPC ..... F21V 23/06; F21V 17/105; F21V 21/084; F21S 9/02
See application file for complete search history.

(56) References Cited

U.S. PATENT DOCUMENTS 8,899,774 B2 * 12/2014 Strong ..... A61B 5/6814 362/572
2019/0390844 A1 * 12/2019 Sedlacek ..... F21V 21/084

FOREIGN PATENT DOCUMENTS

KR 20110092465 A * 8/2011

* cited by examiner

*Primary Examiner* — Anabel Ton
(74) *Attorney, Agent, or Firm* — Schwabe Williamson & Wyatt, P.C.

(57) ABSTRACT

Various embodiments herein provide a headlamp with a light unit, a battery unit, and a booster unit. The booster unit includes an engagement mechanism (e.g., a bar, such as a U-shaped bar) that mechanically couples the booster unit to the battery unit to provide additional power. The engagement mechanism may further form a clip to couple the booster unit to another item when the booster unit is not coupled to the battery unit. The booster unit may include one or more lights, one or more controls for the one or more lights, and/or an outgoing power port to provide power to another device (other than the battery unit and light unit). Other embodiments may be described and claimed.

20 Claims, 12 Drawing Sheets

HEADLAMP WITH BATTERY UNIT AND BOOSTER UNIT

TECHNICAL FIELD

The present disclosure relates generally to the field of headlamps.

BACKGROUND

Headlamps are used in a wide variety of conditions, such as construction/utility work and outdoor recreation (e.g., camping, hiking/walking) among others. Headlamps are battery powered. However, a larger battery leads to increased weight, which can make the headlamp less comfortable to wear over long periods of time.

BRIEF DESCRIPTION OF THE DRAWINGS

Embodiments will be readily understood by the following detailed description in conjunction with the accompanying drawings and the appended claims. Embodiments are illustrated by way of example and not by way of limitation in the figures of the accompanying drawings.

DETAILED DESCRIPTION

Figure 1:
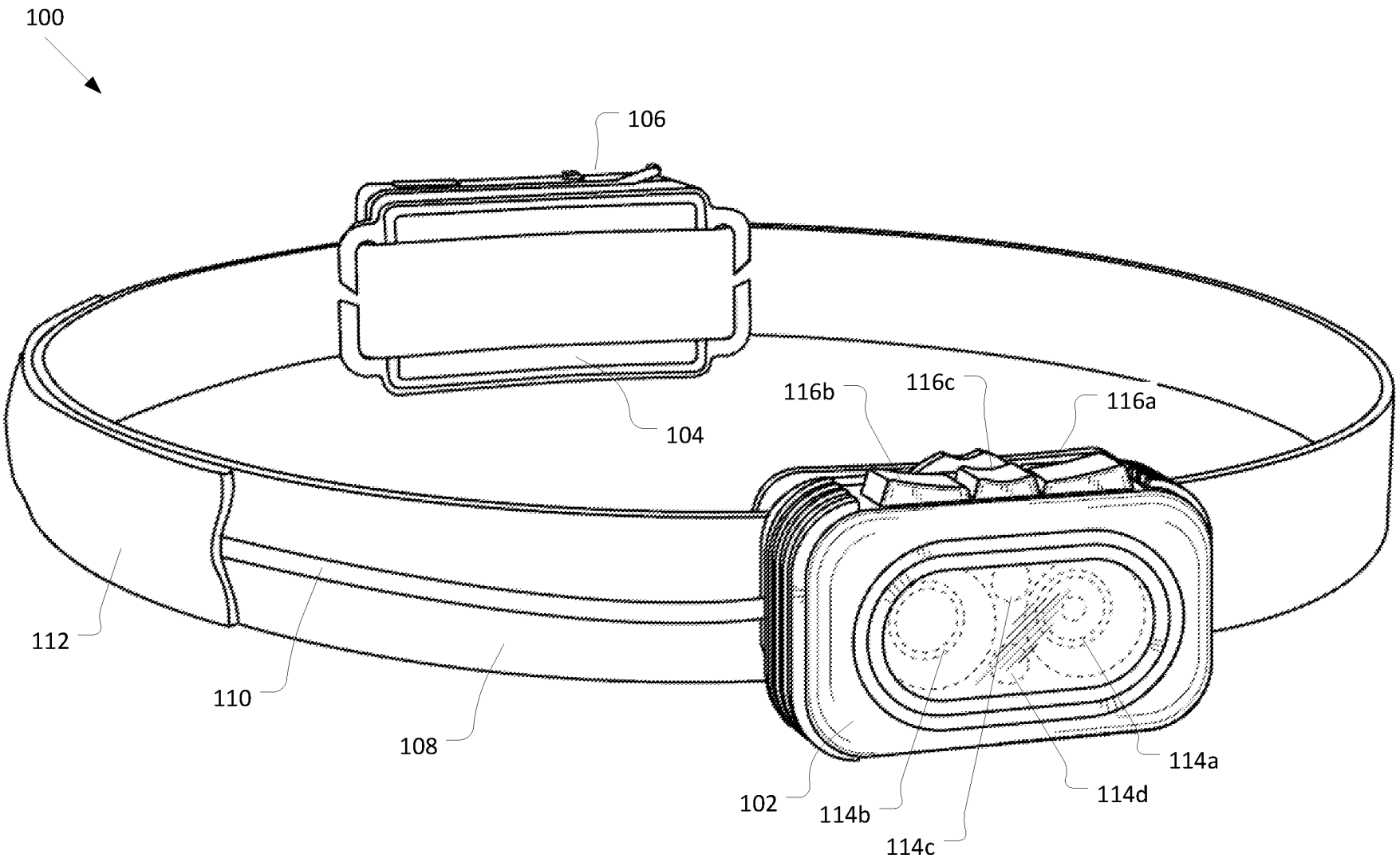
FIG. 1 is a first perspective view of a headlamp with a light unit, a battery unit, and a booster unit, in accordance with various embodiments.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Various operations may be described as multiple discrete operations in turn, in a manner that may be helpful in understanding embodiments; however, the order of description should not be construed to imply that these operations are order dependent.

The description may use perspective-based descriptions such as up/down, back/front, and top/bottom. Such descriptions are merely used to facilitate the discussion and are not intended to restrict the application of disclosed embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact. However, "coupled" may also mean that two or more elements are not in direct contact with each other, but yet still cooperate or interact with each other.

For the purposes of the description, a phrase in the form "A/B" or in the form "A and/or B" means (A), (B), or (A and B). For the purposes of the description, a phrase in the form "at least one of A, B, and C" means (A), (B), (C), (A and B), (A and C), (B and C), or (A, B and C). For the purposes of the description, a phrase in the form "(A)B" means (B) or (AB) that is, A is an optional element.

The description may use the terms "embodiment" or "embodiments," which may each refer to one or more of the same or different embodiments. Furthermore, the terms "comprising," "including," "having," and the like, as used with respect to embodiments, are synonymous, and are generally intended as "open" terms (e.g., the term "including" should be interpreted as "including but not limited to," the term "having" should be interpreted as "having at least," the term "includes" should be interpreted as "includes but is not limited to," etc.).

With respect to the use of any plural and/or singular terms herein, those having skill in the art can translate from the plural to the singular and/or from the singular to the plural as is appropriate to the context and/or application. The various singular/plural permutations may be expressly set forth herein for sake of clarity.

Various embodiments herein provide a headlamp with a light unit, a battery unit, and a booster unit. The light unit, battery unit, and booster unit may be separate units (e.g., have separate housings). The battery unit and light unit may both be coupled to a headband that goes around a user's head. The battery unit may be coupled to the light unit via a power cord to provide power to one or more lights of the light unit. The booster unit may be selectively attached to the battery unit to provide additional power.

When worn the light unit may typically be on a forehead of the user, and the battery unit may be positioned at the back of the head or another suitable position. The light unit may include one or more lights (e.g., light emitting diodes (LEDs)). The one or more lights may project forward and/or in another suitable direction. The light unit may further include one or more controls (e.g., buttons, toggles, sliders, etc.) to control operation of the one or more lights. For example, the one or more controls may turn the light(s) on and off, change an intensity of the light, change a color of light provided by the light unit, change a mode of the light unit (e.g., constant on, flashing, etc.), and/or control other parameters of the light unit.

The battery unit may include one or more batteries to provide power to the one or more lights of the light unit. The one or more batteries may include one or more rechargeable batteries (e.g., a battery pack) and/or single use batteries. In some embodiments, the battery unit may include a battery compartment that is configured to accept a rechargeable battery pack or one or more single use batteries (e.g., AA, AAA, etc.). The battery unit may further include a charging port to enable charging of the rechargeable battery while it is inserted in the battery compartment. In some such embodiments, the rechargeable battery may not be removable.

In some embodiments, the battery unit may further include one or more lights to enhance visibility/safety of the user. The one or more lights may emit white light, red light, and/or another suitable color. The battery unit may further include one or more controls to control operation of the one or more lights.

The power cord that connects the battery unit and the light unit may be permanently or removably coupled to the battery unit and/or light unit. At least a portion of the power cord may be disposed in a sheath of the headband.

The booster unit may include an engagement mechanism to selectively attach the booster unit to the battery unit. For example, the engagement mechanism may include a bar (e.g., a U-shaped bar) that engages with a groove in the battery unit to selectively attach the booster unit to the battery unit. The booster unit and battery unit may additionally or alternatively include one or more magnets to hold the units together in an attached position. The booster unit and battery units may further include one or more battery contacts that are aligned when in the attached position to transfer power from the booster unit to the battery unit. In some embodiments, the engagement mechanism may also form a clip to selectively couple the booster unit to another item (e.g., pocket, hat, etc.) when the booster unit is not attached to the battery unit. For example, the bar may be spaced from the rear surface of the booster unit to form the clip. The bar may be parallel to the rear surface and/or oriented at an angle with respect to the rear surface (e.g., within +/−20 degrees).

The booster unit may include one or more batteries to provide power to the light unit via the battery unit. The one or more batteries may include one or more rechargeable batteries (e.g., a battery pack) and/or single use batteries. In some embodiments, the booster unit may include a battery compartment that is configured to accept a rechargeable battery pack or one or more single use batteries (e.g., AA, AAA, etc.). The battery unit may further include a charging port to enable charging of the rechargeable battery while it is inserted in the battery compartment. In some such embodiments, the rechargeable battery may not be removable. The battery capacity of the booster unit may be the same or different than (e.g., greater or less than) the battery capacity of the battery unit. In one non-limiting example, the battery capacity of the battery unit may be 1500 mAh and the battery capacity of the booster unit may be 2000 mAh.

In some embodiments, the booster unit may further include one or more lights. For example, the booster unit may include one or more lights on the front (facing away from the user's head when attached to the battery unit) and/or sides of the booster unit. The lights may act as safety lights when the booster unit is coupled to the battery unit. Additionally, or alternatively, the lights may be used for other purposes (e.g., task light) when the battery unit is not coupled to the battery unit. In one example, the booster unit includes a forward facing light that emits red light for safety/visibility, and a side-facing light that emits white light to be used as a task light.

In some embodiments, the booster unit may further include a power port to provide power to an external electronic device other than a battery unit or light unit. For example, the power port may be a Universal Serial Bus (USB) port and/or another suitable port. This may enable the booster unit to be used to provide auxiliary power to another electronic device, such as a smart phone, media player, etc. The power port may be the different than or the same as the charging port that enables charging of the battery in the booster unit.

In various embodiments, the booster unit may enable backup power to be conveniently provided to the light unit via the battery unit. Furthermore, the booster unit may provide additional functionality when not coupled to the battery unit. For example, the booster unit may be used as a task light (e.g., flashlight), a safety light, and/or a power bank (e.g., to charge and/or otherwise provide power to another electronic device). Furthermore, the booster unit may be coupled to a pocket, hat, or other location via the integrated clip (which may also engage with the battery unit to attach the booster unit to the light unit).

Aspects of various embodiments are described further below with reference to FIGS. 1-23. FIGS. 1-23 illustrate one example of the embodiments described herein. It will be apparent that modifications, additions, and/or subtractions may be made to the example implementation of FIGS. 1-23 without departing from the scope of the present disclosure.

Furthermore, while embodiments are described herein with reference to a headlamp, the disclosed booster unit and/or battery unit may be used with other types of battery powered devices, such as other types of lighting devices (e.g., a flashlight, work light, lantern, etc.), safety gear, etc.

Figure 2:
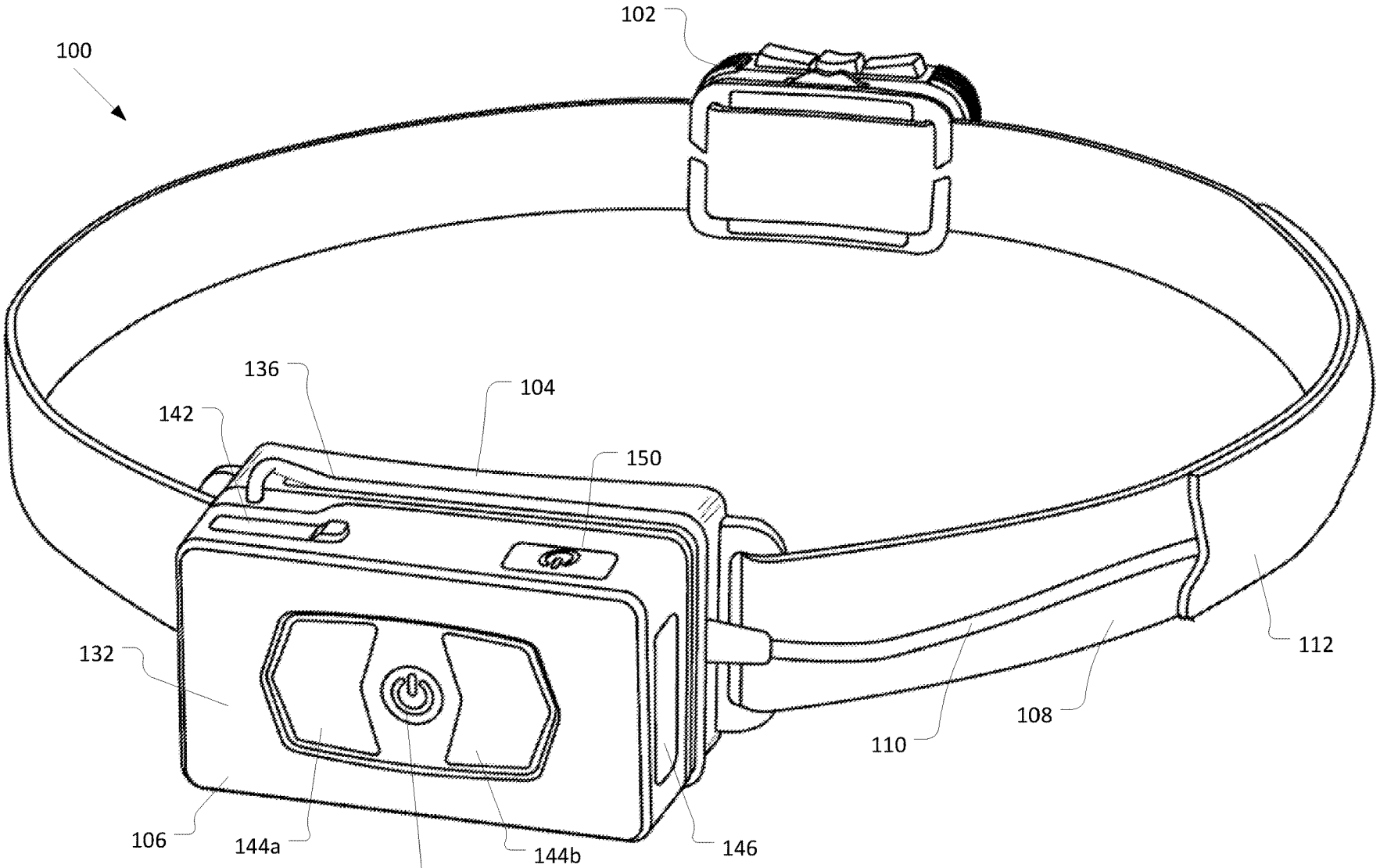
FIG. 2 is a second perspective view of the headlamp, in accordance with various embodiments.
Figure 3:
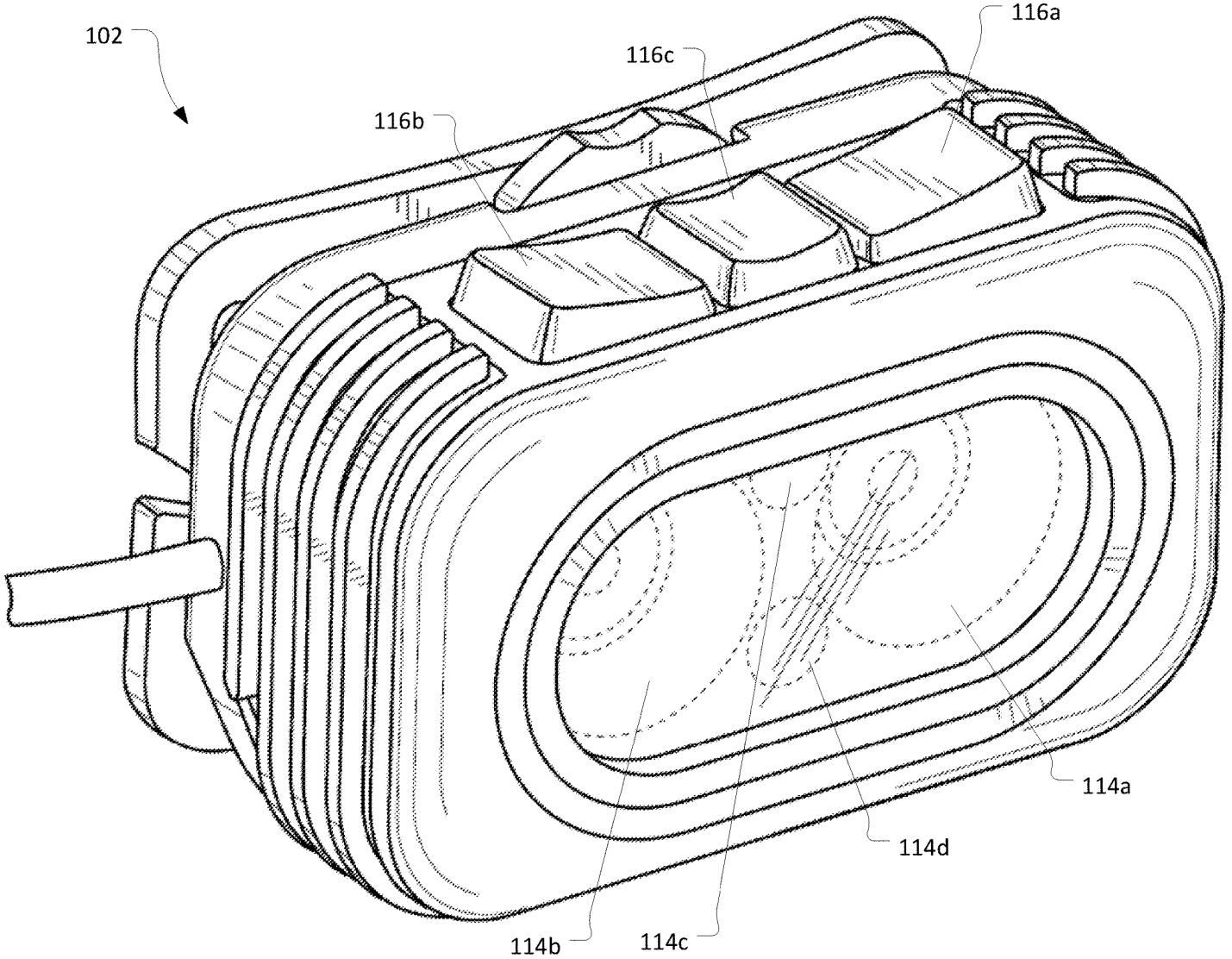
FIG. 3 is a perspective view of the light unit, in accordance with various embodiments.
Figure 4:
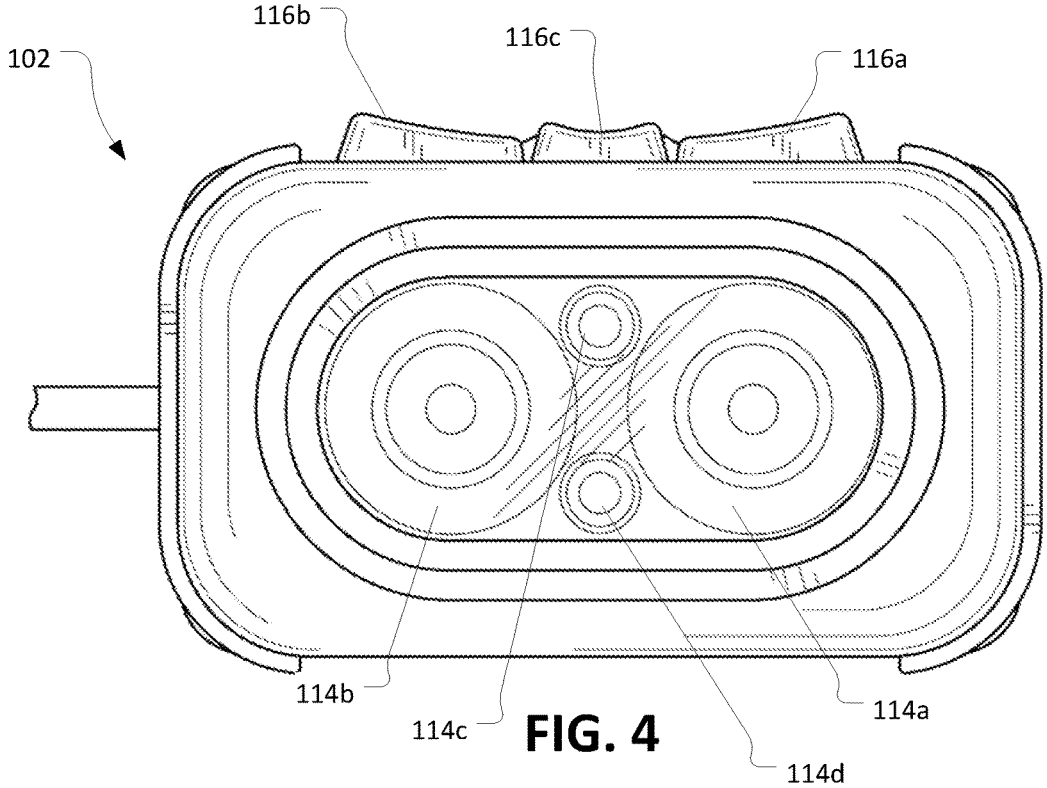
FIG. 4 is a front view of the light unit, in accordance with various embodiments.
Figure 5:
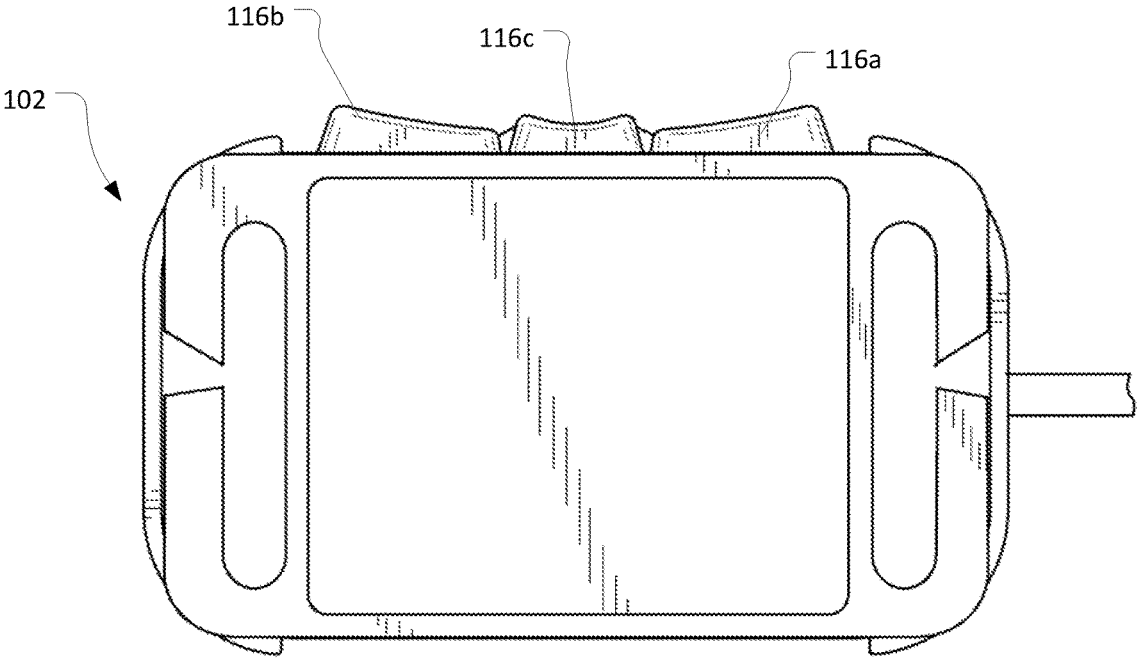
FIG. 5 is a rear view of the light unit, in accordance with various embodiments.
Figure 6:
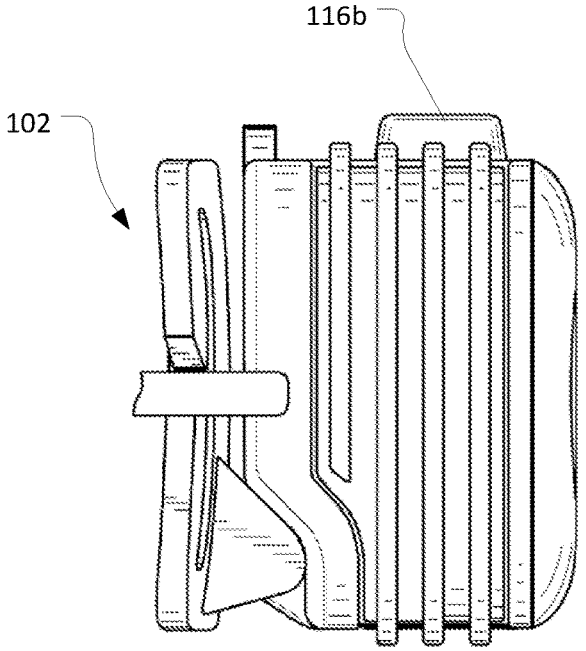
FIG. 6 is a left side view of the light unit, in accordance with various embodiments.
Figure 7:
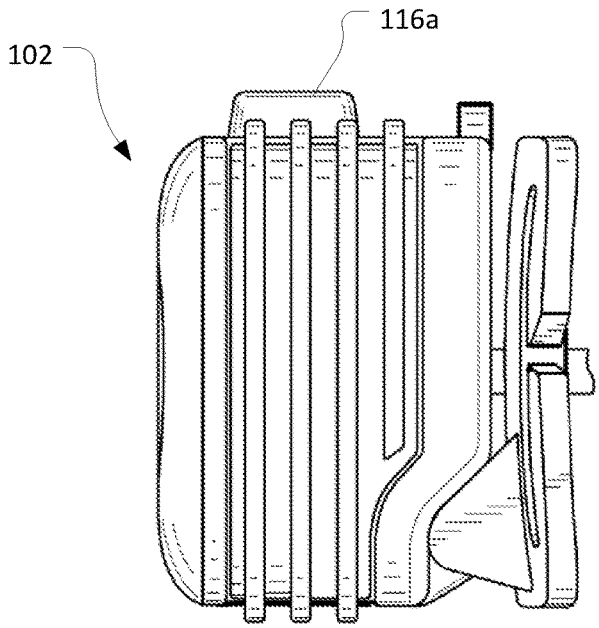
FIG. 7 is a right side view of the light unit, in accordance with various embodiments.
Figure 8:
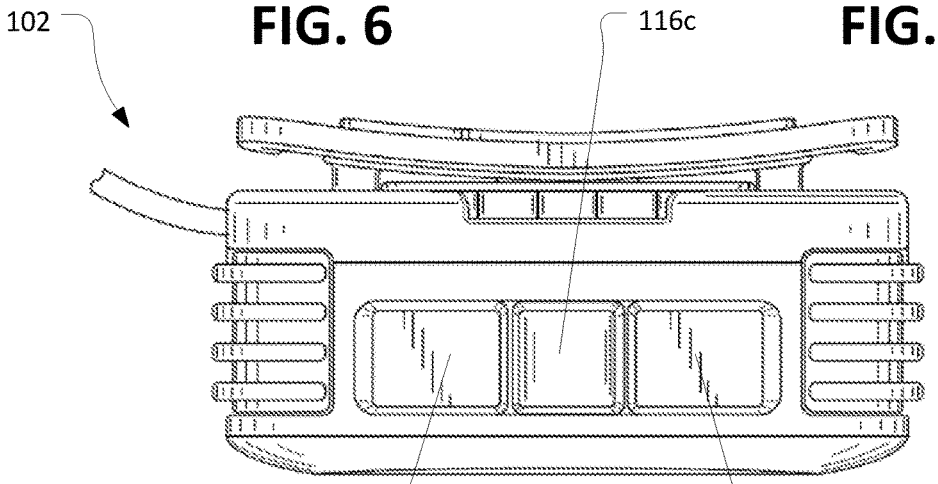
FIG. 8 is a top view of the light unit, in accordance with various embodiments.
Figure 9:
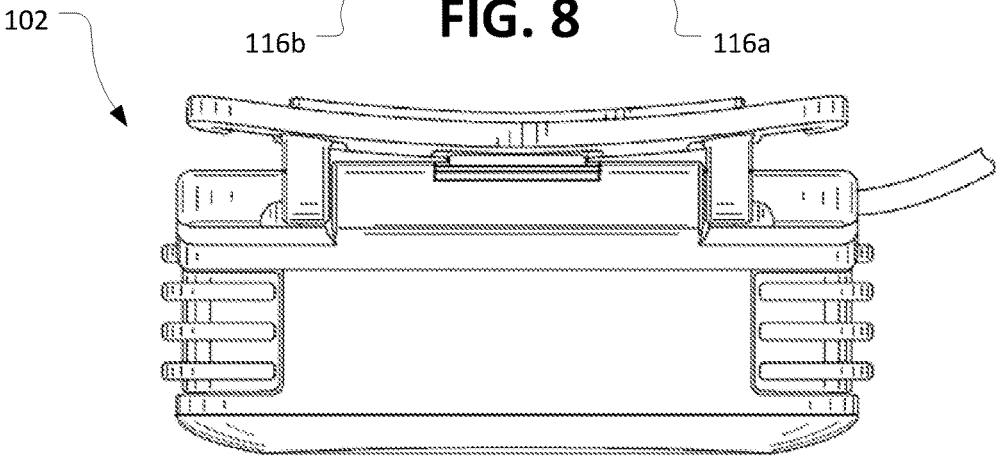
FIG. 9 is a bottom view of the light unit, in accordance with various embodiments.
Figure 10:
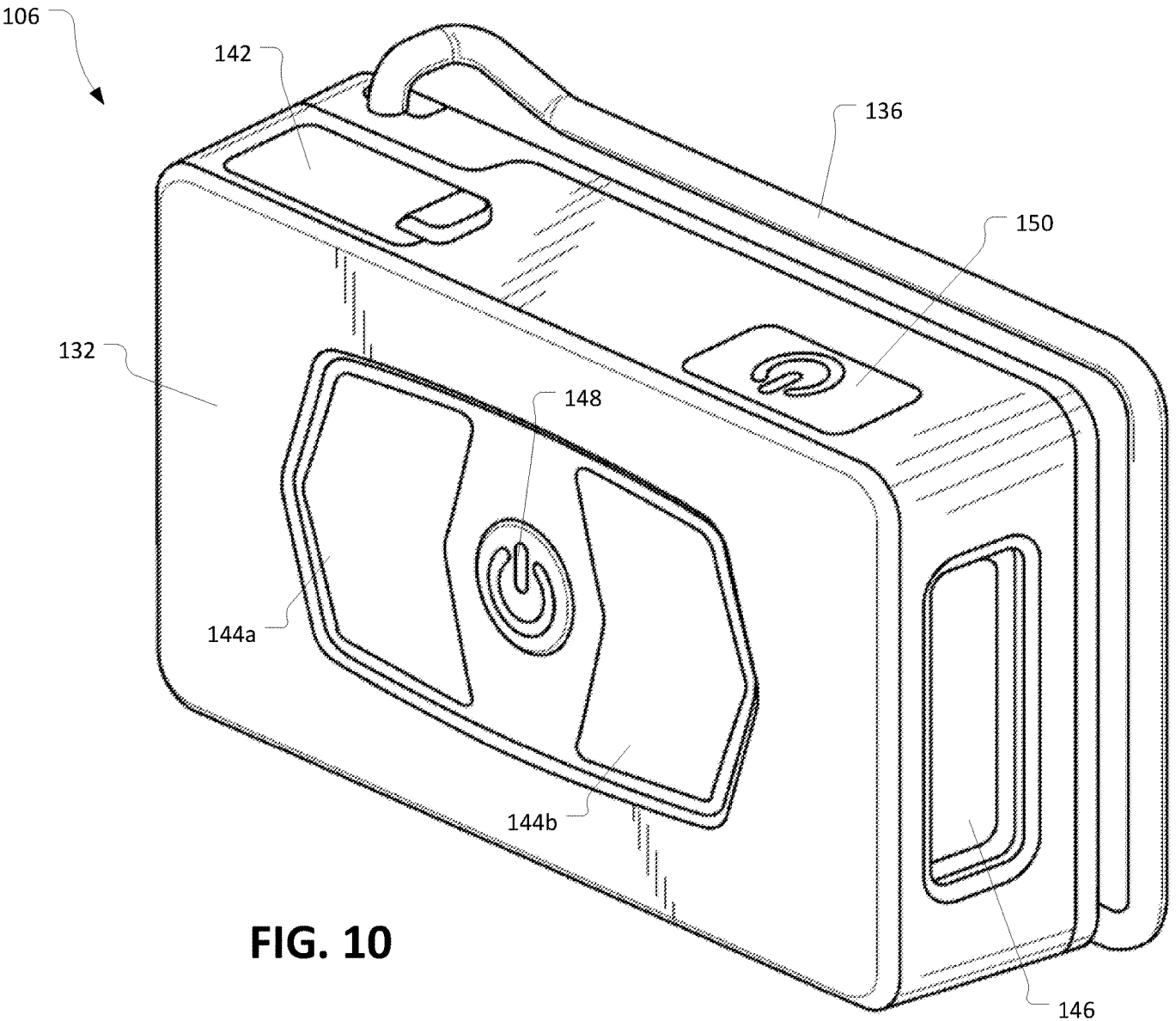
FIG. 10 is a perspective view of the booster unit, in accordance with various embodiments.
Figure 11:
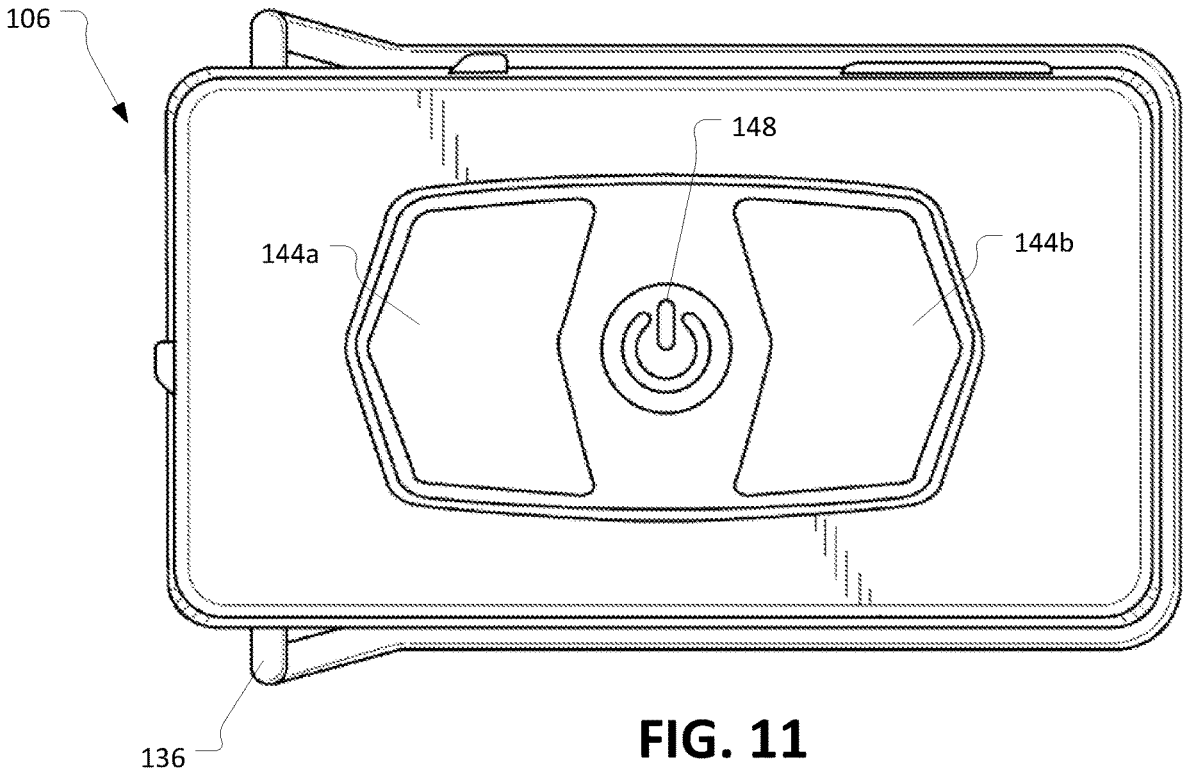
FIG. 11 is a front view of the booster unit, in accordance with various embodiments.
Figure 12:
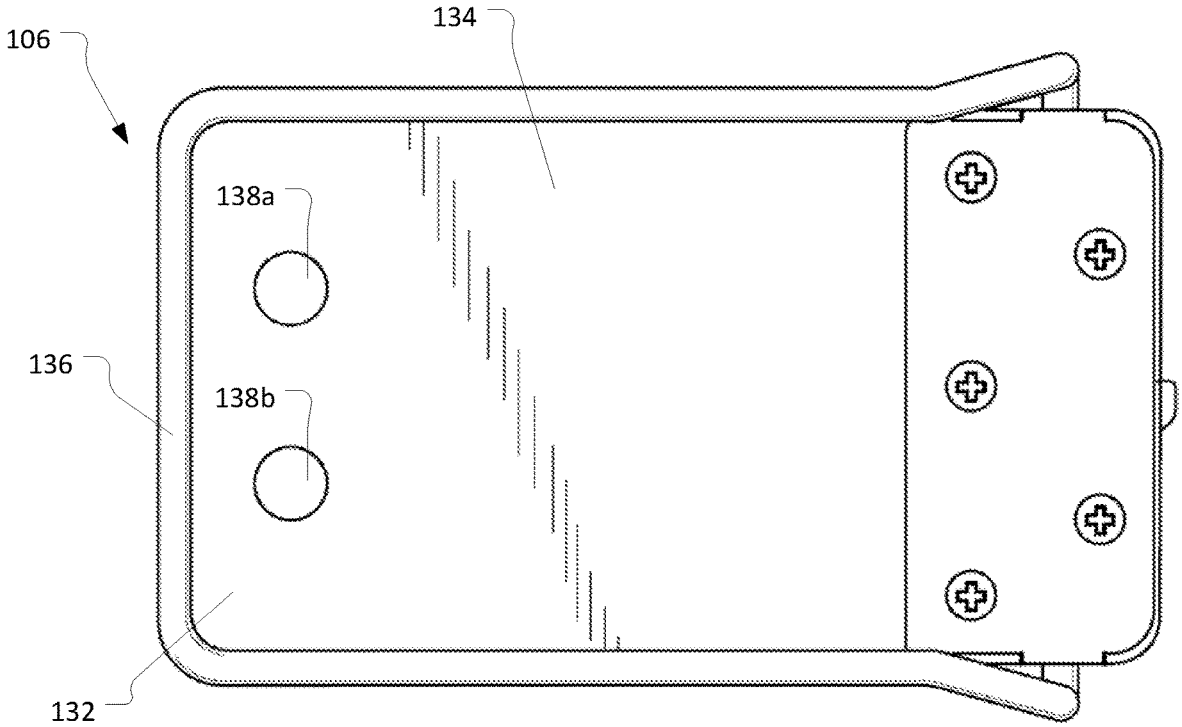
FIG. 12 is a rear view of the booster unit, in accordance with various embodiments.
Figure 13:
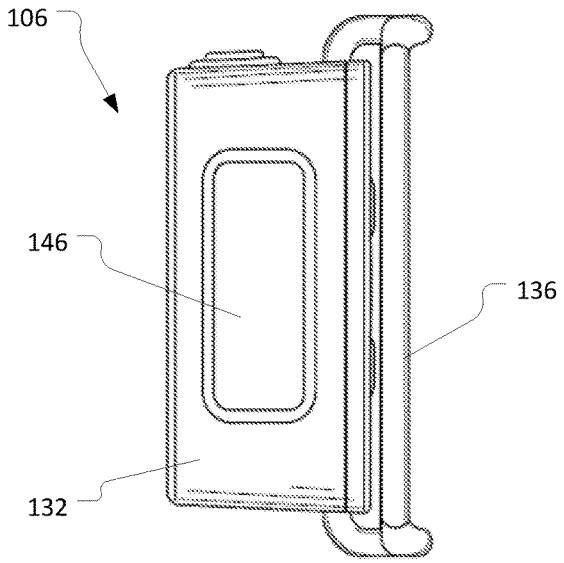
FIG. 13 is a right side view of the booster unit, in accordance with various embodiments.
Figure 14:
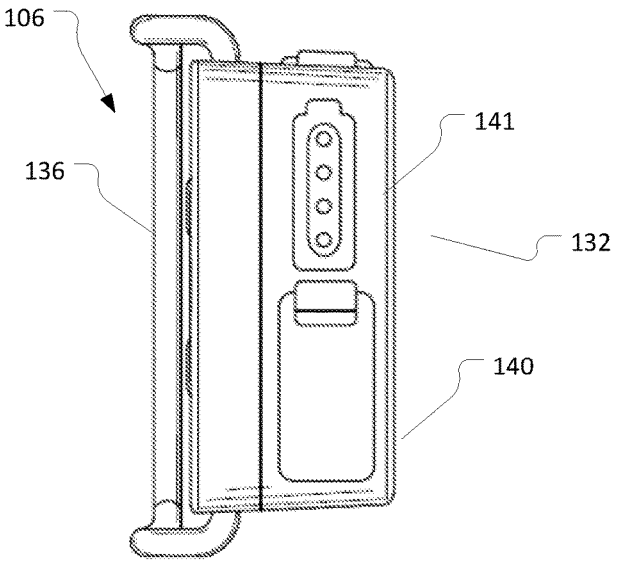
FIG. 14 is a left side view of the booster unit, in accordance with various embodiments.
Figure 15:
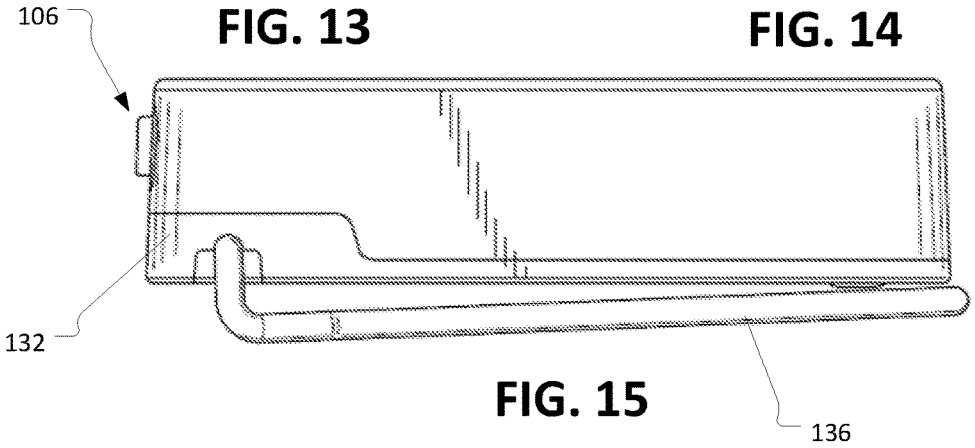
FIG. 15 is a bottom view of the booster unit, in accordance with various embodiments.
Figure 16:
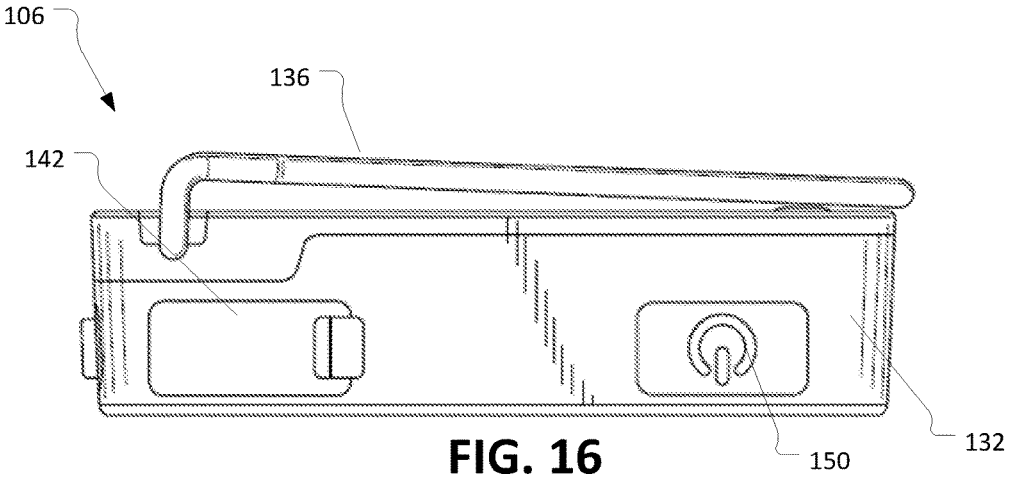
FIG. 16 is a top view of the booster unit, in accordance with various embodiments.
Figure 17:
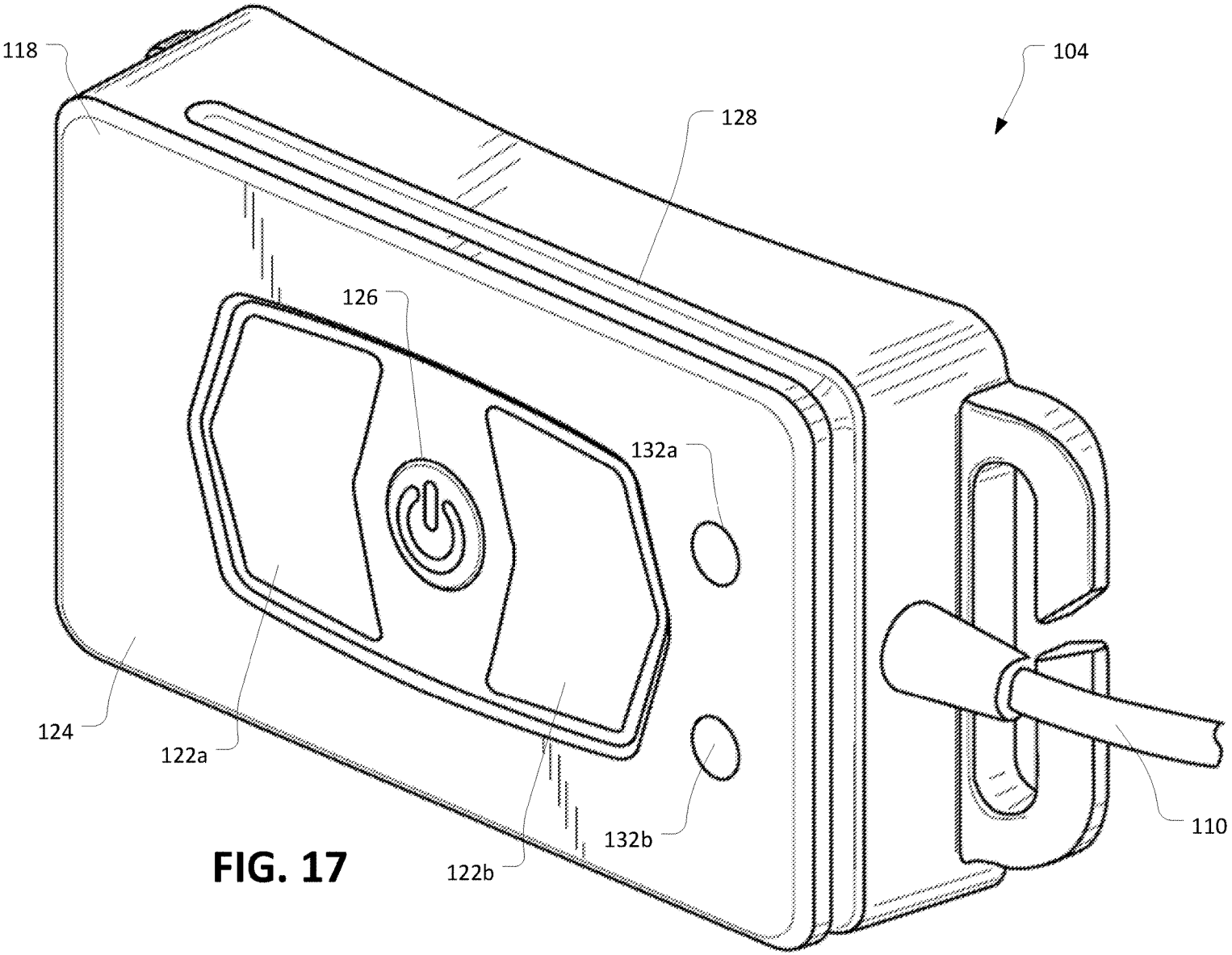
FIG. 17 is a perspective view of the battery unit, in accordance with various embodiments.
Figure 18:
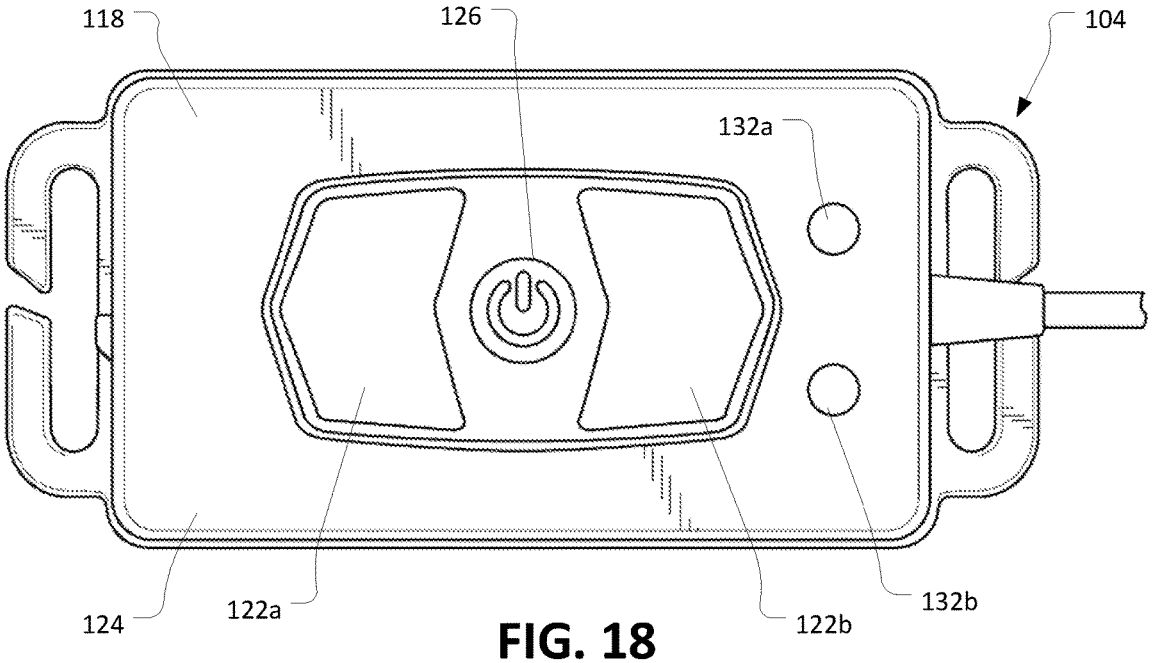
FIG. 18 is a front view of the battery unit, in accordance with various embodiments.
Figure 19:
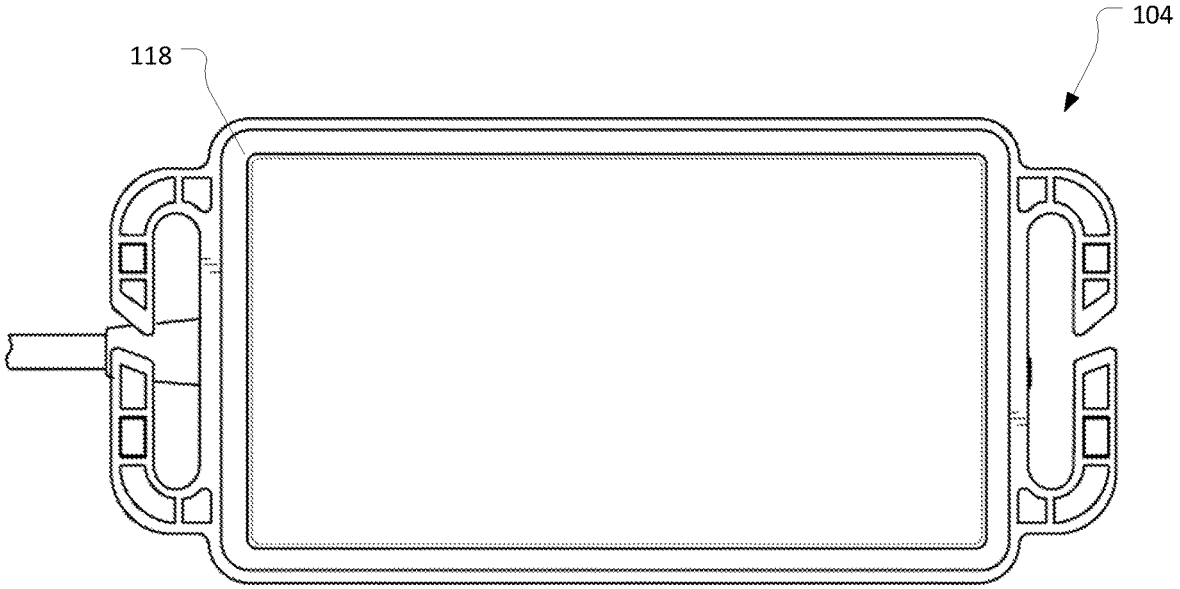
FIG. 19 is a rear view of the battery unit, in accordance with various embodiments.
Figure 20:
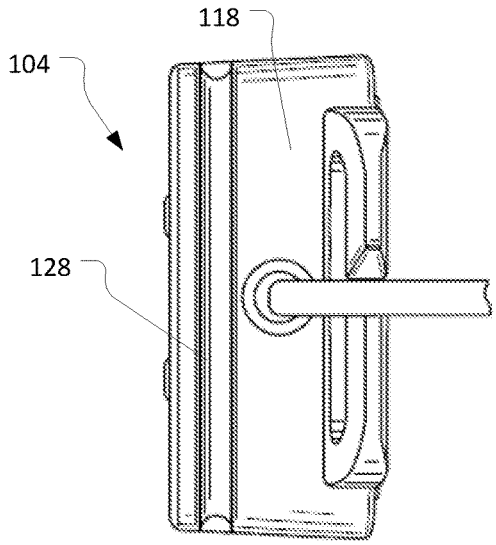
FIG. 20 is a right side view of the battery unit, in accordance with various embodiments.
Figure 21:
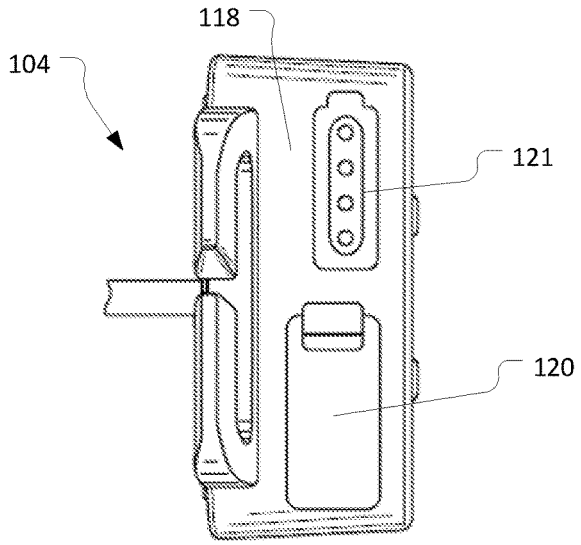
FIG. 21 is a left side view of the battery unit, in accordance with various embodiments.
Figure 22:
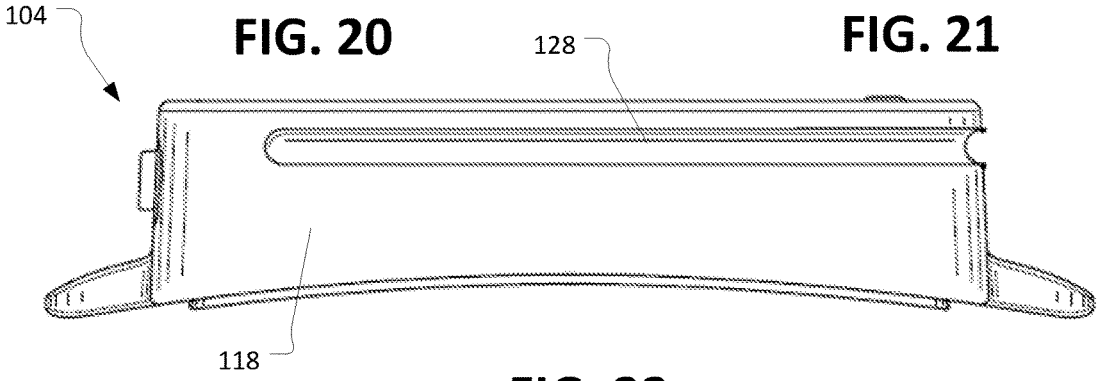
FIG. 22 is a bottom view of the battery unit, in accordance with various embodiments.
Figure 23:
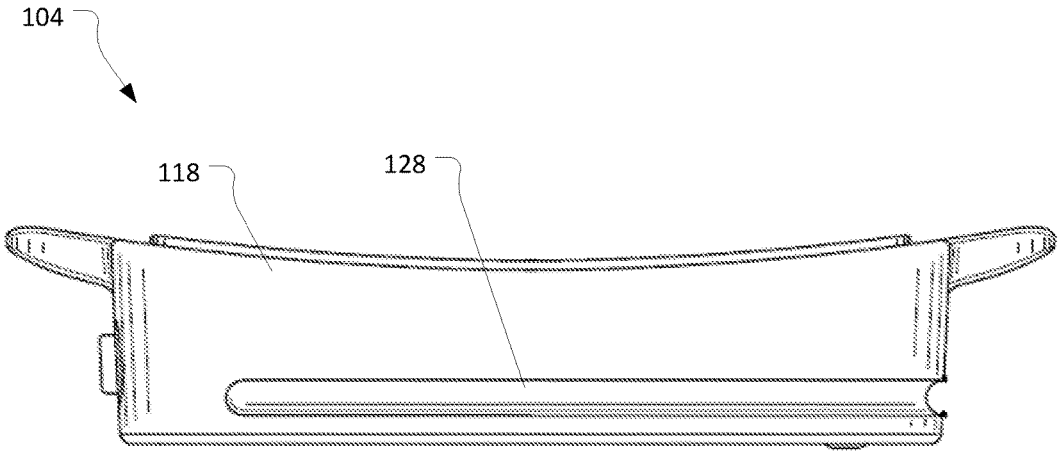
FIG. 23 is a top view of the battery unit, in accordance with various embodiments.
Figure 24:
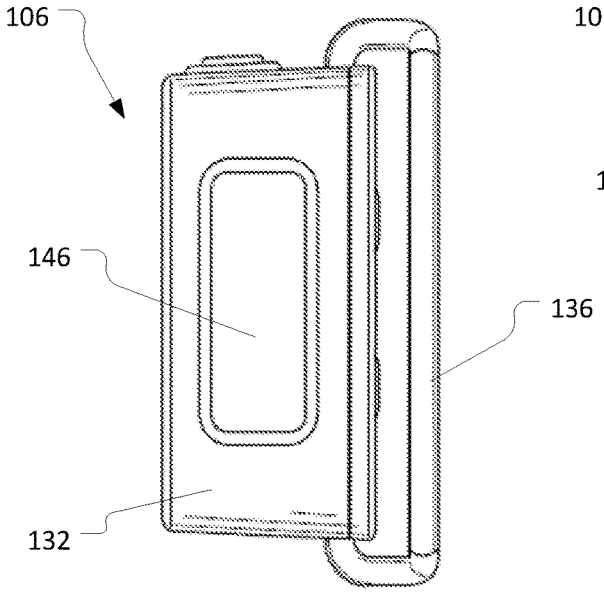
FIG. 24 is a right side view of another embodiment of the booster unit, in accordance with various embodiments.
Figure 25:
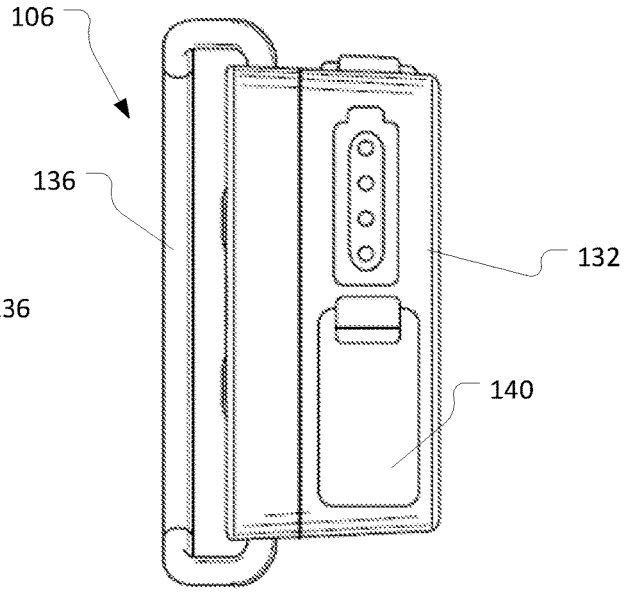
FIG. 25 is a left side view of the booster unit of FIG. 24, in accordance with various embodiments.
Figure 26:
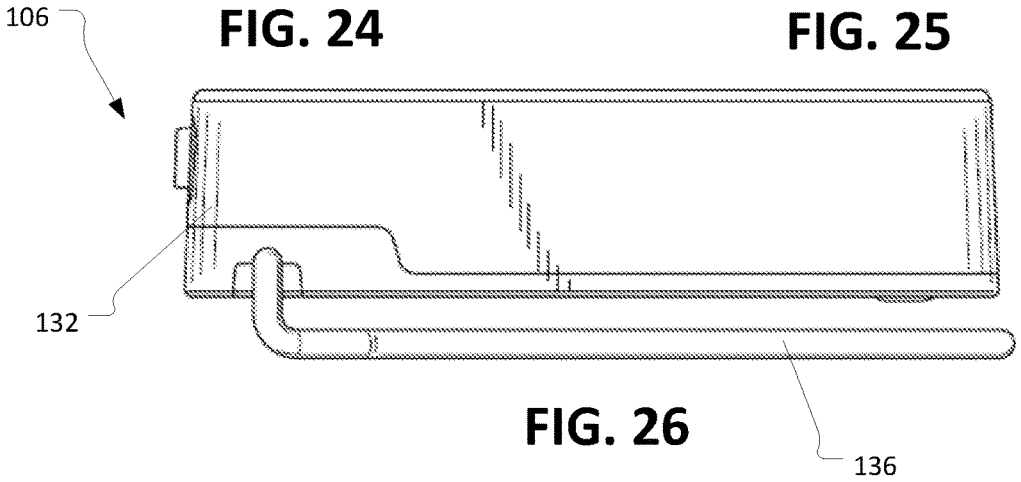
FIG. 26 is a bottom view of the booster unit of FIG. 24, in accordance with various embodiments.
Figure 27:
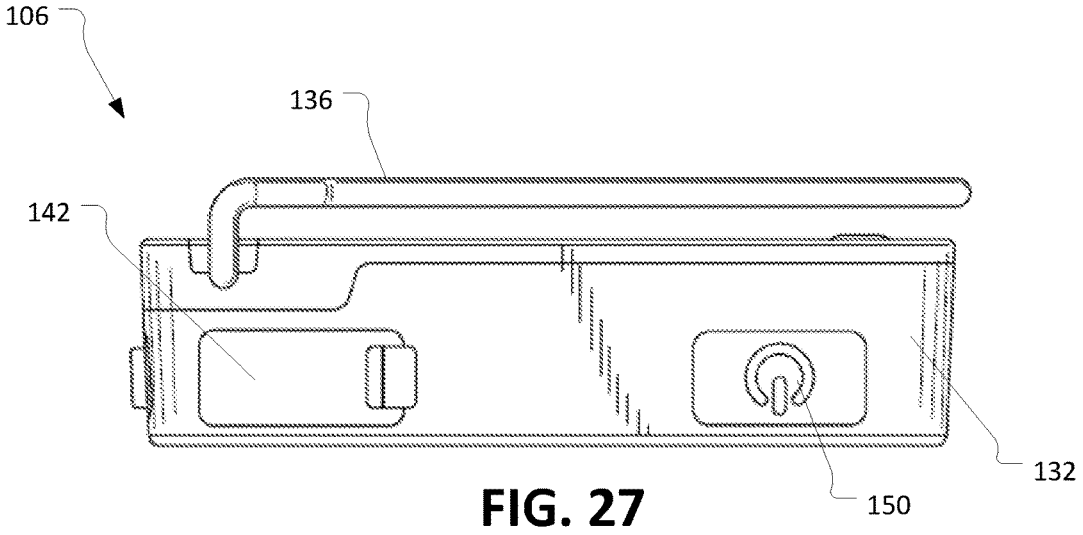
FIG. 27 is a top view of the booster unit of FIG. 24, in accordance with various embodiments.

FIGS. 1 and 2 illustrate a headlamp 100 in accordance with various embodiments. The headlamp 100 includes a light unit 102, a battery unit 104, and a booster unit 106. The light unit 102 and battery unit 104 are coupled to a headband 108 that goes around a user's head. The battery unit 104 is coupled to the light unit 102 via a power cord 110 to provide power to the light unit 102. In some embodiments, the power cord 110 may pass through a sheath 112 in the headband 108. The booster unit 106 may be selectively coupled to the battery unit to provide additional power.

The light unit 102 is further illustrated in FIGS. 3-9. The light unit 102 includes lights 114*a-d* that project forward from a front side of the light unit 102. For example, the lights 114*a-d* include a light 114*a* that projects a flood beam of white light, light 114*b* that projects a spot beam (narrower than the flood beam) of white light, light 114*c* that projects a first color of light (e.g., red), and light 114*d* that projects a second color of light (e.g., green). The lights 114*a-b* may include a light source (e.g., LED) and a lens to focus the light from the light source. The lights 114*c-d* may include a light source (e.g., LED) without a lens. Other configurations of one or more lights may be used in other embodiments. For example, one or more of the lights 114*a-d* may include a chip-on-board LED light, may project another type of beam, and/or may project a different color of light.

The light unit further includes controls 116*a-c* (e.g., buttons) to control the lights 114*a-d*. For example, control 116*a* may control light 114*a*, control 116*b* may control light 114*b*, and control 116*c* may control lights 114*c-d*. The controls 116*a-c* may toggle the lights 114*a-d* on and off. In some embodiments, the controls 116*a-c* may further control one or more parameters of the lights 114*a-d* (e.g., via repeated presses of the buttons to change modes), such as intensity, on duration (e.g., constant on or flashing), color, etc.

The battery unit 104 is further illustrated in FIGS. 17-23. The battery unit 104 includes a housing 118 that contains a rechargeable battery pack to provide power to the lights 114*a-d* of the light unit 102 via the power cord 110. The battery unit 104 further includes a charge port 120 to recharge the battery pack. The charge port 120 may be a USB port or another suitable type of port. Although the battery unit 104 is shown to use a rechargeable battery, other embodiments may use single use batteries and/or a battery compartment that enables the use of either single use batteries or a rechargeable battery pack. In some embodiments, an indicator 121 of a remaining battery charge may be included in the battery unit 104. For example, the indicator 121 may include a plurality of LEDs (e.g., 4 as shown, or another suitable number) and a number of LEDs that are on may correspond to the remaining battery charge.

The battery unit 104 further includes safety lights 122*a-b* (e.g., LEDs) that project light from a front side 124 of the battery unit 104. The safety lights 122*a-b* may emit red light and/or another suitable type of light. The battery unit 104 further includes a control 126 (button) to control the safety lights 122*a-b* (e.g., turn the safety lights 122*a-b* on and off).

The battery unit 104 further includes an engagement mechanism 128 to mechanically couple the battery unit 104 to the booster unit 106 as discussed herein. For example, the engagement mechanism 128 may be in the form of a groove (e.g., U-shaped groove) as shown. In embodiments, at least a portion of the front side 124 may be magnetic to magnetically couple the battery unit 104 to the booster unit 106. The magnetic coupling may be in addition to or instead of the mechanical coupling. The battery unit 104 further includes contacts 130*a-b* to transfer power from the booster unit 106 to the battery unit 104 and/or light unit 102 when the booster unit 106 is coupled to the battery unit 104.

The booster unit 106 is illustrated further in FIGS. 10-16. The booster unit 106 includes a housing 132 with a rear side 134. An engagement mechanism 136 extends rearward from the housing and is configured to mechanically engage with the engagement mechanism 128 of the battery unit 104 to couple the booster unit 106 to the battery unit 104. For example, the engagement mechanism 136 may include a bar (e.g., U-shaped bar) as shown. The bar may be slid into the groove of the battery unit 104 to mechanically couple the booster unit 106 to the battery unit 104. The bar may also form a clip to selectively couple the booster unit 106 to another item (e.g., pocket, hat, etc.) when the booster unit 106 is not attached to the battery unit 104. For example, as shown, the engagement mechanism 136 is spaced from the rear side 134 of the booster unit 106 at a first end 152 (e.g., the open end of the U-shape) and angles toward the rear side 134 to a second end 154 of the engagement mechanism 136 (e.g., the closed end of the U-shape). The second end 153 of the engagement mechanism 136 may be adjacent the rear side 134 of the booster unit 106. Accordingly, the engagement mechanism 136 may be under tension when engaged with the engagement mechanism 128 of the battery unit 104 (e.g., when the engagement mechanism 128 of the battery unit 104 is oriented substantially in parallel to the front side 124 of the battery unit 104), and may be oriented at an angle with respect to the rear side 134 of the booster unit 106 when the booster unit 106 is not coupled to the battery unit 104.

In other embodiments, the engagement mechanism 136 may be in parallel to the rear side 134 of the booster unit 106 when the booster unit 106 is not coupled to the battery unit 104. FIGS. 24-27 illustrate one example of such an embodiment.

In embodiments, at least a portion of the rear side 134 may be magnetic to magnetically couple the booster unit 106 to the battery unit 104 and hold the booster unit 106 in an engaged position. The booster unit 106 further includes contacts 138*a-b* that are aligned with the contacts 130*a-b* of the battery unit 104 when in the engaged position.

The booster unit 106 further includes a rechargeable battery pack in the housing 132 to provide power to the battery unit 104 and/or light unit 102 via contacts 138*a-b* and contacts 130*a-b*. A charge port 140 is included in the booster unit 106 to charge the rechargeable battery pack. Although the battery unit 104 is shown to use a rechargeable battery, other embodiments may use single use batteries and/or a battery compartment that enables the use of either single use batteries or a rechargeable battery pack. In some embodiments, an indicator 141 of a remaining battery charge may be included in the battery unit 104. For example, the indicator 141 may include a plurality of LEDs (e.g., 4 as shown, or another suitable number) and a number of LEDs that are on may correspond to the remaining battery charge.

In some embodiments, the booster unit 106 further includes an outgoing power port 142 that may be coupled to an external electronic device (e.g., smart phone, media player, etc.) to charge or otherwise power that device (e.g., as a power bank). The charge port 140 and/or outgoing power port 142 may be USB ports or another suitable port.

As shown, the booster unit 106 further includes lights 144*a-b* on a front side of the booster unit 106 and a light 146 on a side of the booster unit 106. In some embodiments, the lights 144*a-b* may be safety lights to enhance visibility of the user when the booster unit 106 is attached to the battery unit 104 and the headlamp is being worn by the user. For example, the safety lights may emit colored light (e.g., red light or another color). Alternatively, the lights 144*a-b* may emit white light. The lights 144*a-b* may further be used as safety lights when the booster unit 106 is not coupled to the battery unit 104. For example, the booster unit 106 may be coupled to a pocket, other clothing, or another item and the lights 144*a-b* may be turned on to increase visibility.

The light 146 may or may not be a different type of light than the lights 144*a-b*. For example, as shown, light 146 is a LED COB light to emit white light. The light 146 may primarily be used when the booster unit 106 is not attached to the battery unit 104, e.g., as a task light (e.g., flashlight). In one example, the booster unit 106 may be clipped to a brim of a hat using the engagement mechanism 136, and the light 146 may then be oriented forward with respect to the user to provide a task light. However, the light 146 may also be turned on when the booster unit 106 is coupled to the battery unit 104. The booster unit 106 may include a control 148 (e.g., button) to control the lights 144*a-b* and a control 150 (e.g., button) to control the light 146.

Accordingly, in various embodiments, the booster unit 106 may enable backup power to be conveniently provided to the light unit 102 via the battery unit 104. The booster unit 106 may further provide lights 144*a-b* and/or 146 that may be turned on while attached to the battery unit 104 to enhance visibility. Furthermore, the booster unit 106 may provide additional functionality when not coupled to the battery unit 104. For example, the booster unit 106 may be used as a task light (e.g., flashlight), a safety light, and/or a power bank (e.g., to charge and/or otherwise provide power to another electronic device). Furthermore, the booster unit 106 may be coupled to a pocket, hat, or other location via the integrated clip (which may also engage with the battery unit 106 to attach the booster unit 106 to the light unit 104).

Although certain embodiments have been illustrated and described herein, it will be appreciated by those of ordinary skill in the art that a wide variety of alternate and/or equivalent embodiments or implementations calculated to achieve the same purposes may be substituted for the embodiments shown and described without departing from the scope. Those with skill in the art will readily appreciate that embodiments may be implemented in a very wide variety of ways. This application is intended to cover any adaptations or variations of the embodiments discussed herein. Therefore, it is manifestly intended that embodiments be limited only by the claims and the equivalents thereof.

The invention claimed is:

1. A headlamp system comprising:

a light unit with at least one light;

a battery unit coupled to the light unit via a power cord, wherein the battery unit is to power the at least one light; and a booster unit with an engagement mechanism to be selectively attached to the battery unit to provide additional power for the at least one light, wherein the engagement mechanism includes a bar coupled to a backside of the booster unit to engage with a groove in the battery unit to selectively attach the booster unit to the battery unit.

2. The headlamp system of claim 1, wherein the bar is oriented at an angle with respect to a rear side of the booster unit to form a clip to selectively couple the booster unit to another item when the booster unit is not attached to the battery unit.

3. The headlamp system of claim 1, wherein the battery unit and booster unit each include one or more power contacts to transfer power from the booster unit to the battery unit when the booster unit is attached to the battery unit.

4. The headlamp system of claim 3, wherein the battery unit and booster unit each further include at least one magnet to magnetically couple the battery unit and booster unit in an attached position in which the one or more power contacts of the booster unit are aligned with the one or more power contacts of the battery unit.

5. The headlamp system of claim 1, wherein the at least one light is at least one first light, and wherein the booster unit further includes at least one second light.

6. The headlamp system of claim 5, wherein the at least one second light includes a light on a front surface of the booster unit.

7. The headlamp system of claim 6, wherein the booster unit further includes a third light on a side of the booster unit.

8. The headlamp system of claim 7, wherein the light on the front surface of the booster unit emits red light and the third light on the side of the booster unit emits white light.

9. The headlamp system of claim 1, wherein the booster unit further includes a power port to provide power to an external electronic device other than the battery unit or light unit.

10. The headlamp system of claim 9, wherein the power port is a Universal Serial Bus (USB) port.

11. The headlamp system of claim 1, further comprising a headband coupled to the light unit and the battery unit, wherein the headband is configured to be worn on a head of a user.

12. A headlamp system comprising:

a light unit with at least one light;

a battery unit coupled to the light unit via a power cord, wherein the battery unit is to power the at least one light; and a booster unit with an engagement mechanism to selectively attach the booster unit to the battery unit, wherein the booster unit is to provide additional power for the at least one light;

wherein the battery unit and booster unit each include one or more power contacts to transfer power from the booster unit to the battery unit when the booster unit is attached to the battery unit; and wherein the battery unit and booster unit each further include at least one magnet to magnetically couple the battery unit and booster unit in an attached position in which the one or more power contacts of the booster unit are aligned with the one or more power contacts of the battery unit.

13. The headlamp system of claim 12, wherein the booster unit further includes a power port to provide power to an external electronic device other than the battery unit or light unit.

14. The headlamp system of claim 12, further comprising a headband coupled to the light unit and the battery unit, wherein the headband is configured to be worn on a head of a user.

15. A headlamp system comprising:

a light unit with at least one first light;

a battery unit coupled to the light unit via a power cord, wherein the battery unit is to power the at least one first light; and a booster unit to provide additional power for the at least one first light, wherein the booster unit includes:

an engagement mechanism to selectively attach the booster unit to the battery unit;

a second light on a front surface of the booster unit; and a third light on a side of the booster unit.

16. The headlamp system of claim 15, wherein the second light on the front surface of the booster unit emits red light and the third light on the side of the booster unit emits white light.

17. The headlamp system of claim 15, further comprising a headband coupled to the light unit and the battery unit, wherein the headband is configured to be worn on a head of a user.

18. A headlamp system comprising:

a light unit with at least one light;

a battery unit coupled to the light unit via a power cord, wherein the battery unit is to power the at least one light; and a booster unit with an engagement mechanism to be selectively attached to the battery unit to provide additional power for the at least one light, wherein the booster unit further includes a power port to provide power to an external electronic device other than the battery unit or light unit.

19. The headlamp system of claim 18, wherein the power port is a Universal Serial Bus (USB) port.

20. The headlamp system of claim 18, further comprising a headband coupled to the light unit and the battery unit, wherein the headband is configured to be worn on a head of a user.

* * * * *